US009227700B2

(12) United States Patent
Pontaut et al.

(10) Patent No.: US 9,227,700 B2
(45) Date of Patent: Jan. 5, 2016

(54) TENSIONING AND CONNECTOR SYSTEMS FOR TETHERS

(71) Applicant: Subsea 7 Limited, Sutton (GB)

(72) Inventors: David Pontaut, Rio de Janeiro (BR); Chris Krugel, Westhill (GB)

(73) Assignee: Subsea 7 Limited, Sutton (GB)

( * ) Notice: Subject to any disclaimer, the term of this patent is extended or adjusted under 35 U.S.C. 154(b) by 0 days.

(21) Appl. No.: 14/360,259

(22) PCT Filed: Nov. 15, 2012

(86) PCT No.: PCT/GB2012/052833

§ 371 (c)(1),
(2) Date: May 22, 2014

(87) PCT Pub. No.: WO2013/076461

PCT Pub. Date: May 30, 2013

(65) Prior Publication Data

US 2015/0000579 A1 Jan. 1, 2015

(30) Foreign Application Priority Data

Nov. 22, 2011 (GB) ..... 1120129.0

(51) Int. Cl.
*B63B 21/00* (2006.01)
*B63B 21/10* (2006.01)
(Continued)

(52) U.S. Cl.
CPC ..... *B63B 21/10* (2013.01); *B63B 21/04* (2013.01); *B63B 21/50* (2013.01); *B63B 21/18* (2013.01); *B63B 22/18* (2013.01)

(58) Field of Classification Search
CPC ..... B63B 21/10; B63B 21/50; B63B 21/04; B63B 21/18; B63B 22/18
USPC ..... 114/230.1, 230.2, 230.3, 265, 266, 294; 405/195.1, 203, 205, 223.1, 224
See application file for complete search history.

(56) References Cited

U.S. PATENT DOCUMENTS 4,823,125 A * 4/1989 Rorden et al. ..... 340/853.1
5,951,061 A * 9/1999 Arlt et al. ..... 285/94
(Continued)

FOREIGN PATENT DOCUMENTS

GB 860032 2/1961
GB 2 351 058 12/2000
(Continued)

OTHER PUBLICATIONS

P. Jean et al., "Failure of Chains by Bending on Deepwater Mooring Systems," OTC 17238, Proceedings, Offshore Technology Conference 2005.

*Primary Examiner* — Anthony Wiest
(74) *Attorney, Agent, or Firm* — Levy & Grandinetti

(57) ABSTRACT

A top connector for a tether of a subsea buoy is disclosed. The connector has a support, a lever member movable about a pivot axis, and a chain stop mechanism mounted on the lever member to be situated below the pivot axis in use. The lever member is pivotably connected to the support via a flex joint arranged to bear a tensile load exerted by a top chain of the tether when engaged with the chain stop mechanism. The flex joint improves bending fatigue life of the top chain. A frame extends upwardly from the support to carry a sheave for the top chain. A pivotably connected lever member extends downwardly from the support. The lever member is pivotable relative to the support and the frame, allowing a compact arrangement that avoids the frame, the top chain or the sheave clashing with the shell of the buoy.

23 Claims, 13 Drawing Sheets

(51) Int. Cl.

| | |
|---|---|
| ***B63B 21/04*** | (2006.01) |
| ***B63B 21/50*** | (2006.01) |
| *B63B 21/18* | (2006.01) |
| *B63B 22/18* | (2006.01) |

(56) References Cited

U.S. PATENT DOCUMENTS

| | | | | |
|---|---|---|---|---|
| 6,663,320 | B1 | 12/2003 | Braud et al. | |
| 6,908,260 | B2 * | 6/2005 | Beard et al. | 405/154.1 |
| 2005/0241558 | A1 * | 11/2005 | Barlow | 114/200 |
| 2006/0213418 | A1 | 9/2006 | Boatman et al. | |
| 2010/0175604 | A1 | 7/2010 | Boatman et al. | |

FOREIGN PATENT DOCUMENTS

| | | |
|---|---|---|
| WO | WO 2008/100374 | 8/2008 |
| WO | WO 2010/085156 | 7/2010 |
| WO | WO 2012/001406 | 1/2012 |

* cited by examiner

TENSIONING AND CONNECTOR SYSTEMS FOR TETHERS

This Application is the U.S. National Phase of International Application Number PCT/PGB2012/052833 filed on Nov. 15, 2012, which claims priority to Great Britain Application No. 1120129.0 filed on Nov. 22, 2011.

This invention relates to tensioning and connector systems for tethers of buoyant structures, such as subsea buoys used in hybrid or decoupled riser systems.

Hybrid riser systems have been known for many years for transporting well fluids from the seabed to a surface installation. For example, in a hybrid riser system described in our International Patent Application No. PCT/GB2011/051223, a subsea riser support extends from seabed foundations to a riser support buoy held buoyantly in mid-water.

A riser support buoy is sometimes referred to in the art by the acronym BSR, derived from the Portuguese term 'bóia de suporte de riser'. For brevity, that acronym will be used to identify riser support buoys in the description that follows.

A BSR is tethered under tension to its foundations, to lie at a depth below the influence of likely wave action. The BSR shown in PCT/GB2011/051223 is generally rectangular in plan view and has four sets (in this example, pairs) of tethers, each set being attached by top connectors to a respective corner region of the BSR.

Riser pipes extend between the seabed and the tethered BSR. The riser pipes typically hang freely from the BSR as steel catenary risers or SCRs, although other materials may be used for those pipes. Flexible jumper pipes communicating with the SCRs hang as catenaries extending from the BSR to an FPSO (floating production, storage and offloading) vessel or other surface installation, such as a platform. The compliant jumper pipes decouple the more rigid SCRs from surface movement induced by waves and tides. The SCRs experience less stress and fatigue as a result.

To meet operational requirements, it is important that a BSR is maintained at an appropriate depth and at an appropriate location and orientation in the water. It is also important that the tethers each bear an appropriate share of the buoyant load of the BSR. A problem in these respects is that tether elements such as spiral strand wire (SSW) will undergo various phases of extension when subjected to high tension.

Whilst some extension characteristics are well-known and easily predictable, other extension characteristics are not accurately predictable. Over great tether lengths such as 2000 m or more, this unpredictability is such as to produce inaccuracies that must be addressed. This problem is compounded by thermal expansion and contraction, extension due to rotation, and extension due to wear.

For these reasons, it is necessary to have a system for tension adjustment to balance loads in the tethers. In PCT/GB2011/051223, the tension adjustment system comprises tensioning modules mounted on the BSR that each serve as a top connector for a respective tether. Each tensioning module is mounted on a respective hang-off porch defining a support bracket that extends outwardly like a shelf from a side shell of the BSR. The tensioning module comprises chain stops functioning as a ratchet mechanism that engage with links of a top chain connected to a central length of SSW of the tether.

The chain stops in PCT/GB2011/051223 are supported at the lower end of a guide member extending downwardly as part of a pivotable articulating member supported in a socket on the hang-off porch. The articulating member and the socket have complementary part-spherical bearing surfaces that together define a ball-and-socket joint.

The spherical bearing allows the tensioning module to adapt to varying inclinations of the departure axis of the associated tether. This is necessary because the lateral load applied by water currents means that a BSR will not always float directly above its foundations; also, the BSR may tilt during installation or otherwise during its operational lifetime, for example as SCRs are attached to or removed from the buoy. The BSR may also experience slight wave-induced pitch forces through movement of the jumper pipes that extend from the BSR to the surface. Consequently, over time, the departure axes of the tethers will vary in inclination relative to the vertical and to the side shell of the BSR. If handled incorrectly, this can cause stress concentrations in the top chains of the tethers adjacent their connections with the BSR, which can lead to premature failure of the top chains.

As the chain stops in PCT/GB2011/051223 are situated below the pivot axis of the spherical bearing, the guide member that supports them defines a lever arm. The objective of the lever arm is to ensure that any change in the inclination of the tether relative to the BSR will cause the articulating member to pivot in the socket to the same extent. Such movement of the articulating member relative to the socket is necessary for alignment with the tether departure axis.

In PCT/GB2011/051223, an arm of the articulating member extends upwardly from the spherical bearing and ends with a sheave over which a tail portion of the top chain is draped. The tail portion of the top chain ends with a dead weight attached to its free end, hanging below the sheave. This arrangement requires measures to avoiding clashing with the vertical side shell of the BSR if the tether adopts an extreme departure angle. Specifically, the pivot axis of the spherical bearing must be positioned far enough away laterally from the side shell that the top of the arm, the sheave and the tail portion of the top chain cannot clash with the side shell when the arm pivots inboard about the bearing.

In a practical example, safety margins dictate that the maximum permitted departure angle of the tether is 15° either side of vertical, even if its deflection from the vertical will generally be much less in practice. Also, the arm of the articulating member may typically extend upwards about seven metres above the pivot axis of the spherical bearing. Given such dimensions, geometry in this example requires the pivot axis of the spherical bearing to be spaced more than two metres outboard from the side shell of the BSR.

The outboard spacing of the pivot axis from the side shell of the BSR increases the size, weight and cost of each hang-off porch and its supporting structures; it also increases the moment of the porches acting upon the BSR, to the possible detriment of its stability.

Thus, to reduce the size of a hang-off porch without introducing clashing problems, the invention resides in a top connector for a tether of a tethered buoyant structure, the top connector comprising: a support defining a pivot axis; a frame extending above the support when oriented for use, the frame carrying chain-management features for supporting a portion of a chain of the tether in use; and a lever member extending below the support when oriented for use, the lever member being pivotably connected to the support for movement about the pivot axis; wherein the lever member is pivotable relative to the support and the frame.

As the lever member can move independently of the frame, the risk of clashing with the buoyant structure is mitigated. The frame is preferably integral with or otherwise fixed to the support to remain in fixed relation to the buoyant structure as the lever member pivots to follow variations in the departure angle of the tether.

The chain-management features carried by the frame suitably include a sheave over which a non-tensioned tail portion of the chain passes and preferably also a chain tail guide such as a chute. The sheave preferably carries the non-tensioned portion from one side of the frame to the other, namely from a vertical chain axis extending through the support on one side of the frame to the chain tail guide on the other side of the frame. The chain tail guide is suitably arranged to guide the non-tensioned portion downwardly and outwardly from the sheave, away from the frame and optionally also away from the buoyant structure. The chain tail guide can preferably be adjusted, for example by being reconfigured or reassembled, to direct the chain tail to either side of the tether axis.

In theory, pivoting of an articulating member as disclosed in PCT/GB2011/051223 ensures that the load-bearing section of the chain is always under tension only, with no kink or bend in that section of the chain adjacent the chain stops to cause localised overloading or wear over time. In this respect, the links of a chain tend to lock together under high tension loads so that the chain behaves like a rod when exposed to bending stresses.

In practice, however, large tension loads in the tethers make the frictional forces between the bearing surfaces of the articulating member and the socket so high as to hinder initial movement of the articulating member relative to the socket. In other words, a large break-out load must be applied to the articulating member to initiate relative movement of the bearing elements. This means that movement of the articulating member will not faithfully follow variations in the departure angle of the tether; indeed, the articulating member may not respond to micro-angular movements of the tether (of less than say one or two degrees) at all.

Consequently there will still tend to be a slight kink or bend in the load-bearing section of the chain adjacent the chain stops. Also, when the articulating member starts to move when the break-out load overcomes friction in the spherical bearing, its movement may be jerky and this could impart shock loadings to the chain. Thus, some risk remains of fatigue failure or excessive wear of the chain.

To address this problem, a preferred aspect of the invention contemplates the lever member being pivotably connected to the support via a flex joint arranged to bear a tensile load exerted by the chain of the tether when engaged with a chain stop mechanism carried by the lever member.

The flex joint preferably comprises a resilient annular bush connected to the lever member, in which case the support suitably comprises an annular collar that surrounds and defines a seat for the bush.

A flex joint has been found to have important advantages over a spherical bearing in the context of the present invention. The bush of the flex joint suffers no erosion and its composition and construction may be tailored to suit the intended fatigue life of a particular project. Specifically, by varying the stiffness of the bush and by lengthening the lever arm of the lever member that applies torque to the bush as the departure angle of the tether varies, the flex joint may be made responsive to micro-angular movements of the tether to minimise the inter-link angle of the top chain.

As the flex joint is responsive to micro-angular movements in the tether of less than say 1° to 2°, the lever member is able to pivot relatively freely in a manner that reduces bending fatigue in the chain. The bending fatigue life of the chain is further improved because the flex joint imparts a restoring force to the chain via the lever member. Another advantage of the flex joint over a spherical bearing is its compactness, which allows the size, mass and cost of the porch to be reduced to maximise the benefits of the invention. Size-for-size, a flex joint also allows a larger central aperture for the chain than is allowed by a spherical joint of similar outer diameter, permitting additional clearance around the chain to reduce wear and not to hinder free angular movement of the chain links within the flex joint.

In a broad sense, the invention is not limited to the use of a flex joint and could, in principle, be realised with a spherical joint defining the pivot axis. In this respect, it may be possible to reduce the break-out load of a spherical bearing to achieve acceptable bending fatigue life of the chain by reducing friction with the use of suitable low-friction bearing materials or by minimising the contact area of the bearing surfaces. However, this involves a trade-off in the strength and wear-resistance of the bearing itself. A spherical bearing that is strong enough and wear-resistant enough for demanding applications is likely to be so large as to require an enlarged porch and to suffer from a high break-out load that causes fatigue problems in the chain. It therefore remains preferred, and is synergistically advantageous, to employ a flex joint in the top connector of the invention.

The chain stop mechanism suitably comprises dogs biased to engage the chain as a ratchet when the chain is pulled through the chain stop mechanism on tensioning the tether. The dogs of the chain stop mechanism may be released to free the chain for slackening the tether.

The frame of the top connector of the invention is suitably offset, preferably in an inboard direction in use, from the chain axis extending through the support to the circumference of the sheave. This provides clearance on the outboard side of the chain axis for access to the top chain by a tensioner unit that may be mounted on the frame above the support.

The tensioner unit may be integrated with or independent of the top connector of the invention, to act on a portion of the chain on the chain axis above the support. The inventive concept therefore embraces a top connector having attachment formations for attachment of a tensioner unit; a tensioner unit having attachment formations for attachment to a top connector; and the combination of such a top connector and such a tensioner unit, whether they are integrated or separable.

Whilst the support of the top connector may be integral with the buoyant structure, it is preferred that the support is separate from and attachable to the buoyant structure, for example by an underwater docking procedure in the case of a BSR. The remainder of the top connector is suitably attached to the buoyant structure along with the support, which is in fixed relation to the buoyant structure.

Advantageously, therefore, the top connector has various features to enable it to be lifted onto the buoyant structure, and to ensure its correct seating and location when it is attached to the buoyant structure. For example, an underside of the top connector may at least partially define an interface surface for load transmission between the top connector and the buoyant structure. That interface surface advantageously includes an underside of the support and is preferably substantially planar.

The top connector, preferably the support part of the top connector, may have at least one locating formation arranged to lock the top connector against movement relative to the buoyant structure. Such a locating formation suitably projects from the top connector, and there may be more than one such formation. For example, there may be two or more locating formations such as trunnions extending in opposite directions from the support. Those trunnions may have lifting formations such as padeyes.

The inventive concept extends to a tethered buoyant structure such as a BSR in combination with, or arranged for attachment of, at least one top connector of the invention. Again, whilst the top connector could be integral with the buoyant structure, it is preferred that the buoyant structure is arranged for attachment of at least one separate top connector.

Consequently, the buoyant structure suitably has counterpart seating and location features to those of the top connector, which are suitably defined by a porch extending laterally from a side shell of the buoyant structure. Those features may include a shelf or other interface surface opposed to and complementary with the interface surface of the top connector; they may also include at least one locating formation cooperable with the locating formation(s) of the top connector. For example, the porch may have webs supporting the shelf that have locating recesses shaped to receive the trunnions extending from the support.

In order that the invention may be more readily understood, embodiments of it will now be described, by way of example only, with reference to the accompanying drawings, in which.

Figure 1:
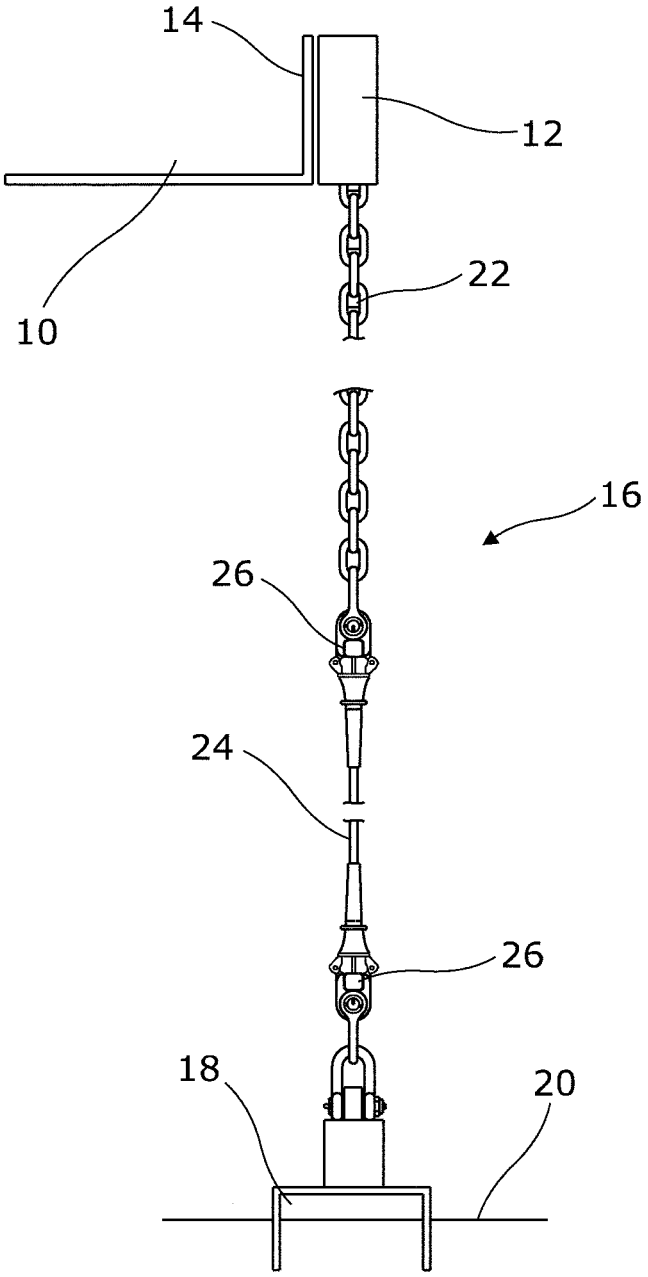
FIG. 1 is a schematic side view of a tether arrangement for a BSR.

FIG. 1 of the drawings puts the invention into context. It shows, schematically, a lower corner of a BSR 10 having a top connector 12 mounted beside the side shell 14 of the BSR 10 near its lower edge. Via the top connector 12, the BSR 10 is held against its buoyancy by a tether 16 extending to a foundation 18 such as a pile embedded in the seabed 20.

The tether 16 comprises a top chain 22, a length of SSW 24 (which is typically thousands of metres in length, so is shown here greatly abbreviated), and shackles 26 that join the top chain 22 to the SSW 24 and the SSW 24 to the foundation 18.

In practice, the BSR 10 will be held by multiple tethers 16 (typically eight tethers arranged in four pairs) and will have a corresponding number of top connectors 12 distributed around its side shell 14.

Figure 2:
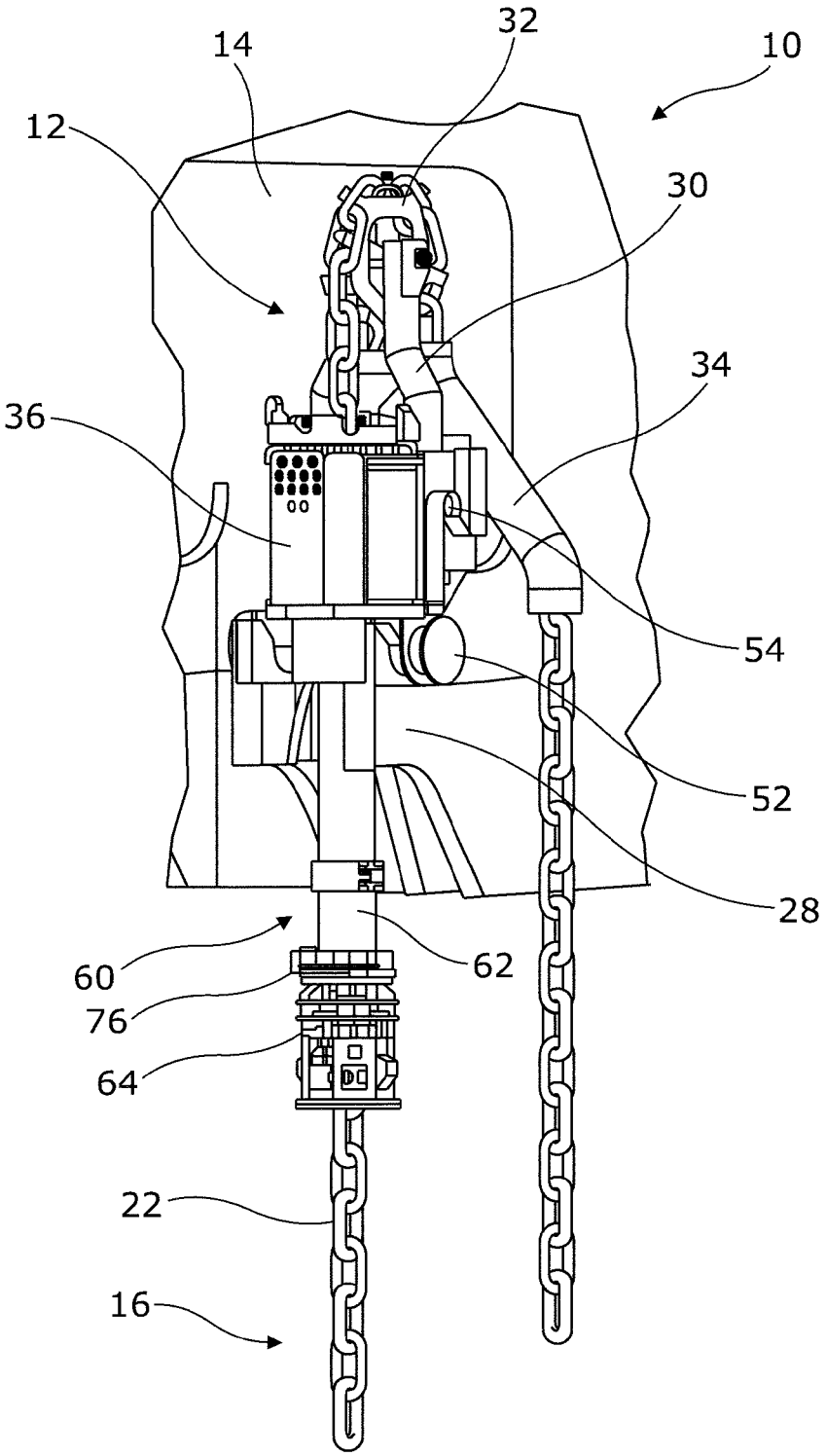
FIG. 2 is a perspective view of a top connector of the invention in situ on a porch extending from a side shell of a BSR.

FIG. 2 shows the top connector 12 in overview, mounted beside the side shell 14 of the BSR 10 and being engaged with the top chain 22 of the tether 16. The top connector 12 is shown here supported by a porch 28 extending laterally from the side shell 14 near its lower edge.

The top connector 12 comprises a frame 30 that rests on the porch 28. At its upper end, the frame 30 supports an idler sheave 32 and a tubular chute 34 for routing and managing a normally non-tensioned tail portion of the top chain 22. The sheave 32 turns relative to the frame 30 about a horizontal axis parallel to the side shell 14 of the BSR 10. The frame 30 also supports a tensioner unit 36 cooperable with the top chain 22, which allows the top connector 12 to serve as a tensioning module; the tensioner unit 36 will be described in detail later, with reference to FIGS. 17 to 22.

Figure 3:
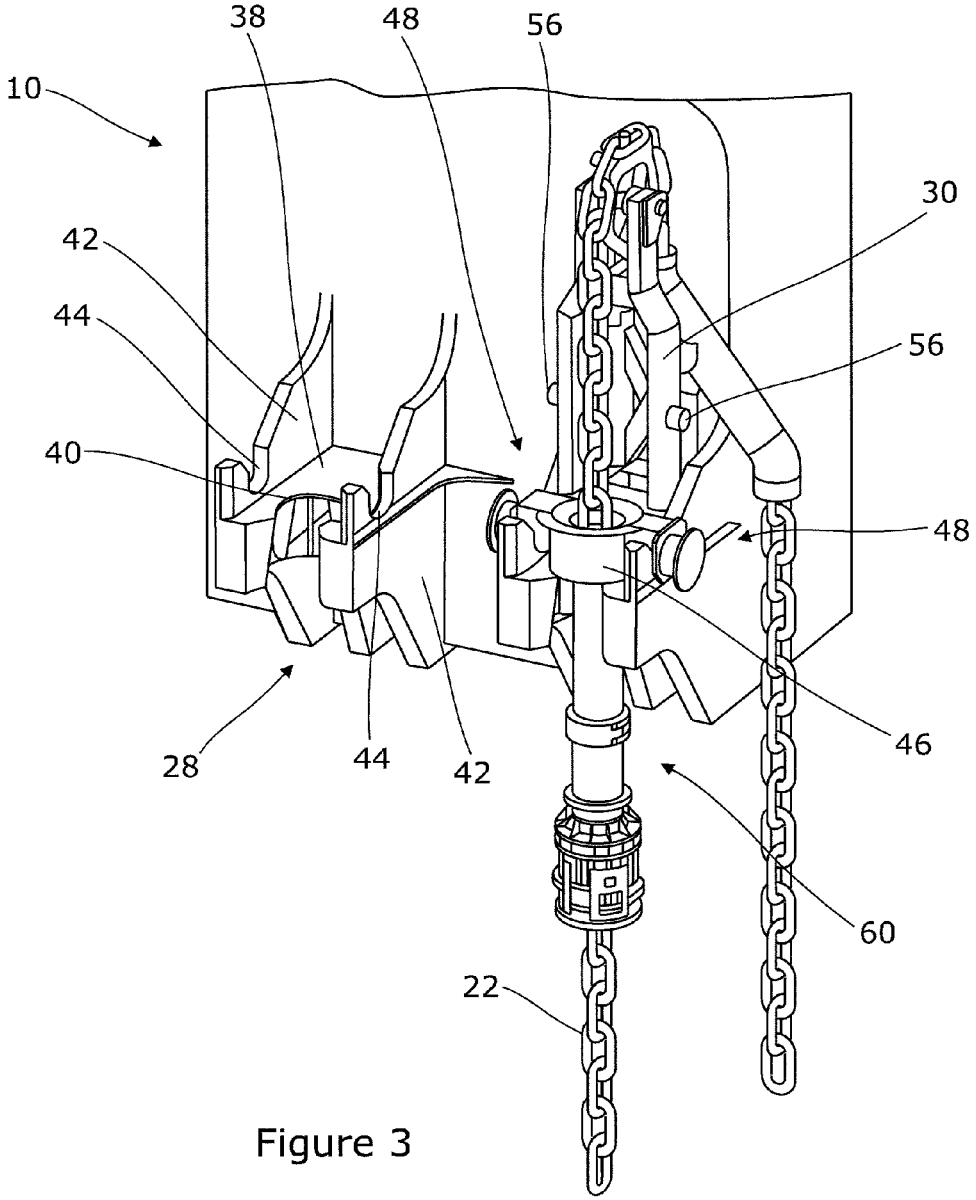
FIG. 3 is a perspective view of the top connector of FIG. 2 but with a tensioner unit removed from the module, and also showing a neighbouring porch without a top connector.

Reference is now also made to FIGS. 3 to 8, which show the top connector 12 with the tensioner unit 36 removed, and particularly to FIG. 3 which shows a neighbouring porch 28 for a paired tether 16 without a top connector 12 in place. This shows clearly that each porch 28 comprises a flat horizontal shelf 38 extending orthogonally outwardly from the side shell 14 of the BSR 10. The shelf 38 has a central cut-out 40 in its outboard edge, with sides of the cut-out 40 being flared to ease docking of the top connector 12 with the porch 28. The shelf 38 is supported to both sides by a pair of vertical webs 42 also extending outwardly from the side shell 14. The upper edges of the webs 42 have U-shaped seat formations 44 that align with each other on a horizontal axis parallel to the side shell 14.

The frame 30 has a flat bottom that rests on the flat shelf 38 of a porch 28. On its outboard side, the bottom of the frame 30 comprises a circular collar 46 whose vertical central axis is parallel to the side shell 14 of the BSR 10. The collar 46 rests on the shelf 38 in alignment with the cut-out 40 in the outboard edge of the shelf 38.

Figure 5:
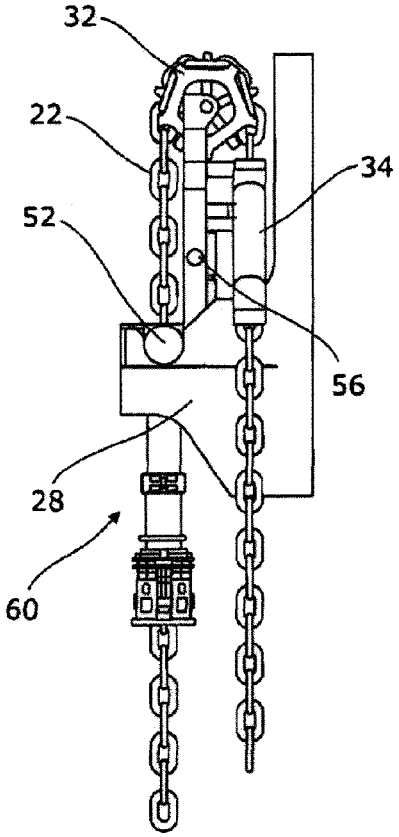
FIG. 5 is a side view of the top connector of FIGS. 3 and 4.
Figure 6:
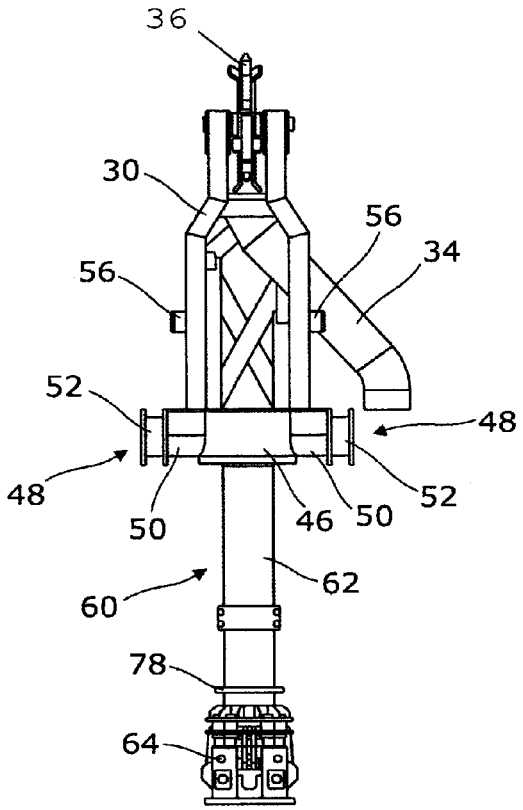
FIG. 6 is an enlarged front view of the top connector shown in FIG. 3, shown separately from the BSR and without a top chain or tensioner unit.

Trunnions 48 extend radially in opposite directions on a horizontal axis aligned with a diameter of the collar 46. FIGS. 3 and 5 show how the trunnions 48 are received by the seat formations 44 of the webs 42. As best shown in FIG. 6, the trunnions 48 have inner U-section portions 50 complementary to the U-shape of the seat formations 44 and terminate outwardly in lifting padeyes 52.

Figure 4:
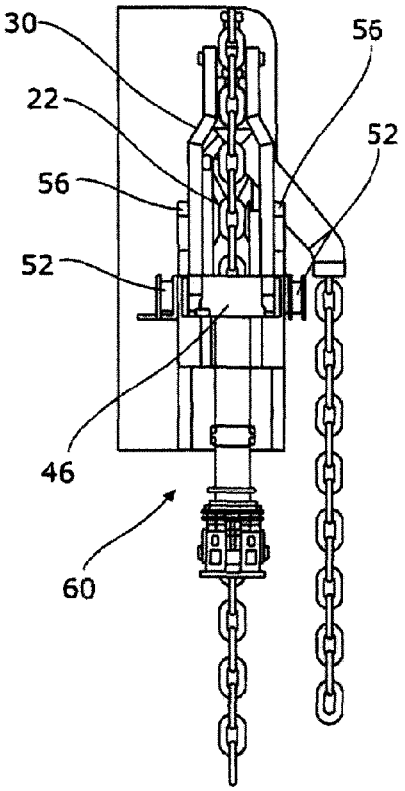
FIG. 4 is a front view of the top connector of FIG. 3.

As best shown in FIG. 4, the lifting points 52 project beyond the webs 42 when a top connector 12 is positioned on a porch 28. The lifting points 52 enable each top connector 12 to be lifted and lowered onto its porch 28 during installation of the BSR 10. To engage the top connector 12 with the porch 28, the trunnions 48 are aligned with the seat formations 44 of the webs 42 and the top connector 12 is lowered while maintaining that alignment. The flat bottom of the frame 30 then rests on the shelf 38 while being locked against movement relative to the porch 28.

The tensioner unit 36 shown in FIG. 2 is then lifted separately onto the frame 30 of the top connector 12, where it is held by a pair of downwardly-opening hooks 54 on its inboard side that engage with a corresponding pair of lugs 56 on the frame 30.

As the collar 46 is on the outboard side of the frame 30, the frame 30 is offset inboard from the vertical central axis of the collar 46. The inboard offset of the frame 30 is such as to place the axis of rotation of the sheave 32 inboard of the central axis of the collar 46 by a distance corresponding to the radius of the sheave 32. It follows that the outboard side of the circumference of the sheave 32 is vertically above the centre of the collar 46. Hence, the portion of the top chain 22 extending between the sheave 32 and the collar 46 is kept on a vertical axis, parallel with the side shell 14 of the BSR. The tensioner unit 36 engages that vertical portion of the top chain 22 as will be explained.

The top chain 22 extends over the sheave 32 and from there downwardly into the chute 34, which is on the inboard side of the frame 30. The chute 34 is curved and inclined so as to guide the top chain 22 from the sheave 32 downwardly and outwardly in a plane parallel to the side shell 14 of the BSR 10, to a hanging axis spaced horizontally from the frame 30 and from the side shell 14. The chute 34 can preferably be adjusted, for example by being reconfigured or reassembled, to direct the tail portion of the top chain 22 in different directions. This ensures clearance between the tail portion and the BSR 10, the top connector 12 and tether 16, depending upon the position of the top connector 12 on the side shell 14 of the BSR 10.

Figure 7:
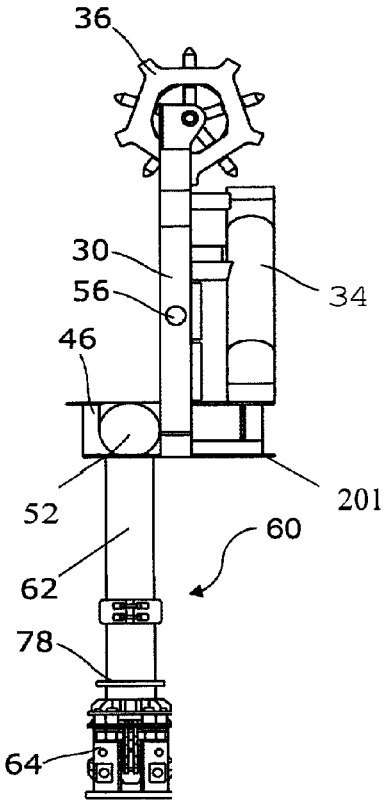
FIG. 7 is a side view of the top connector of FIG. 6.
Figure 8:
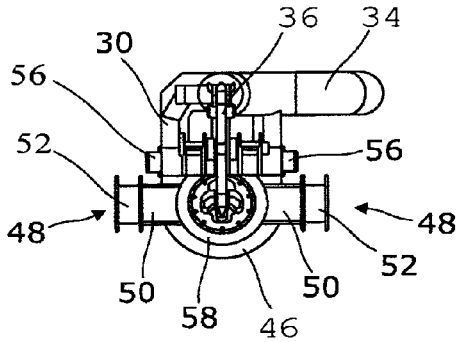
FIG. 8 is a top view of the top connector of FIGS. 6 and 7.

As can be seen in the top view of FIG. 8, the collar 46 holds an annular flex joint 58 that encircles the top chain 22. FIGS. 2, 6 and 7 best show that the flex joint 58 supports an articulating member 60 that comprises a downwardly-extending down tube 62 accommodated in the cut-out 40 in the shelf 38 of the porch 28. The down tube 62 surrounds the top chain 22 as a chain guide and terminates at its lower end in a chain stop mechanism 64 situated below the pivot axis of the flex joint 58. FIG. 7 also shows the underside 201 of the top connector 12 which may at least partially define an interface surface for load transmission between the top connector 12 and the buoyant structure.

On docking the top connector 12 with the porch 28, the down tube 62 enters the cut-out 40 in the shelf 38, assisted by the flared sides of the cut-out 40.

Like PCT/GB2011/051223, the rigid, pivotally-mounted down tube 62 constitutes a lever arm whose purpose is to cause the articulating member 60 to pivot about the flex joint 58 in response to changes in the inclination of the top chain 22 relative to the BSR 10.

Figure 9:
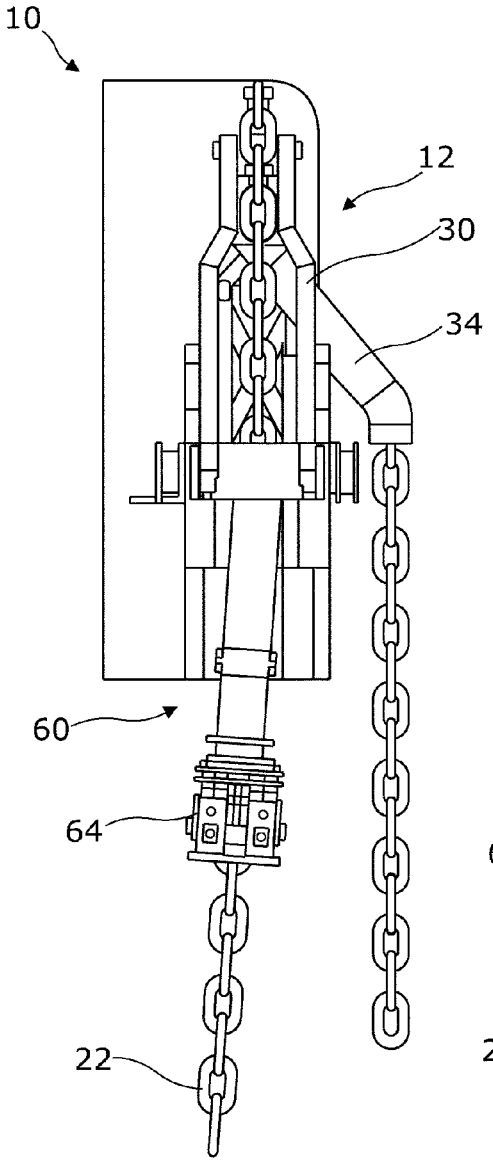
FIG. 9 is a front view corresponding to FIG. 4 but showing an articulating member pivoted relative to a frame supporting chain management features.
Figure 10:
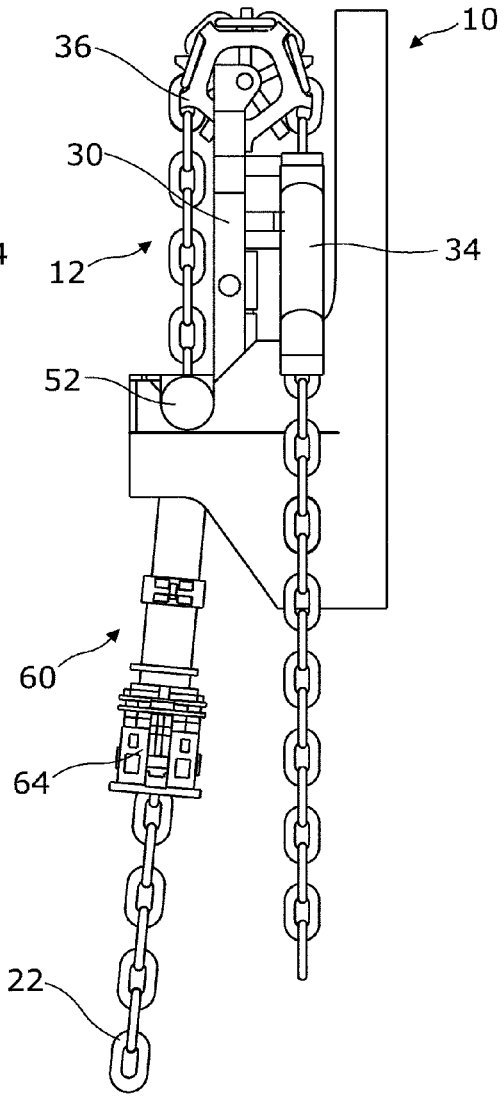
FIG. 10 is a side view corresponding to FIG. 9.

Unlike PCT/GB2011/051223, the frame 30 above the pivot axis 200 of the flex joint 58 remains in fixed relation to the porch 28 and hence to the BSR 10. Thus, the articulating member 60 pivots relative to the frame 30: the frame 30 does not pivot with the articulating member 60. This pivoting movement of the articulating member 60 relative to the frame 30 is shown in FIGS. 9 and 10 and is advantageous because there is no need to accommodate angular movement of structures above the shelf 38 of the porch 28. This means that the pivot axis of the flex joint 58 can be relatively close to the side shell 14 of the BSR 10 and so the porch 28 need not extend as far outwardly from the side shell 14 as in the prior art. The porch 28 can be considerably smaller and hence less massive and costly as a result.

Figure 11:
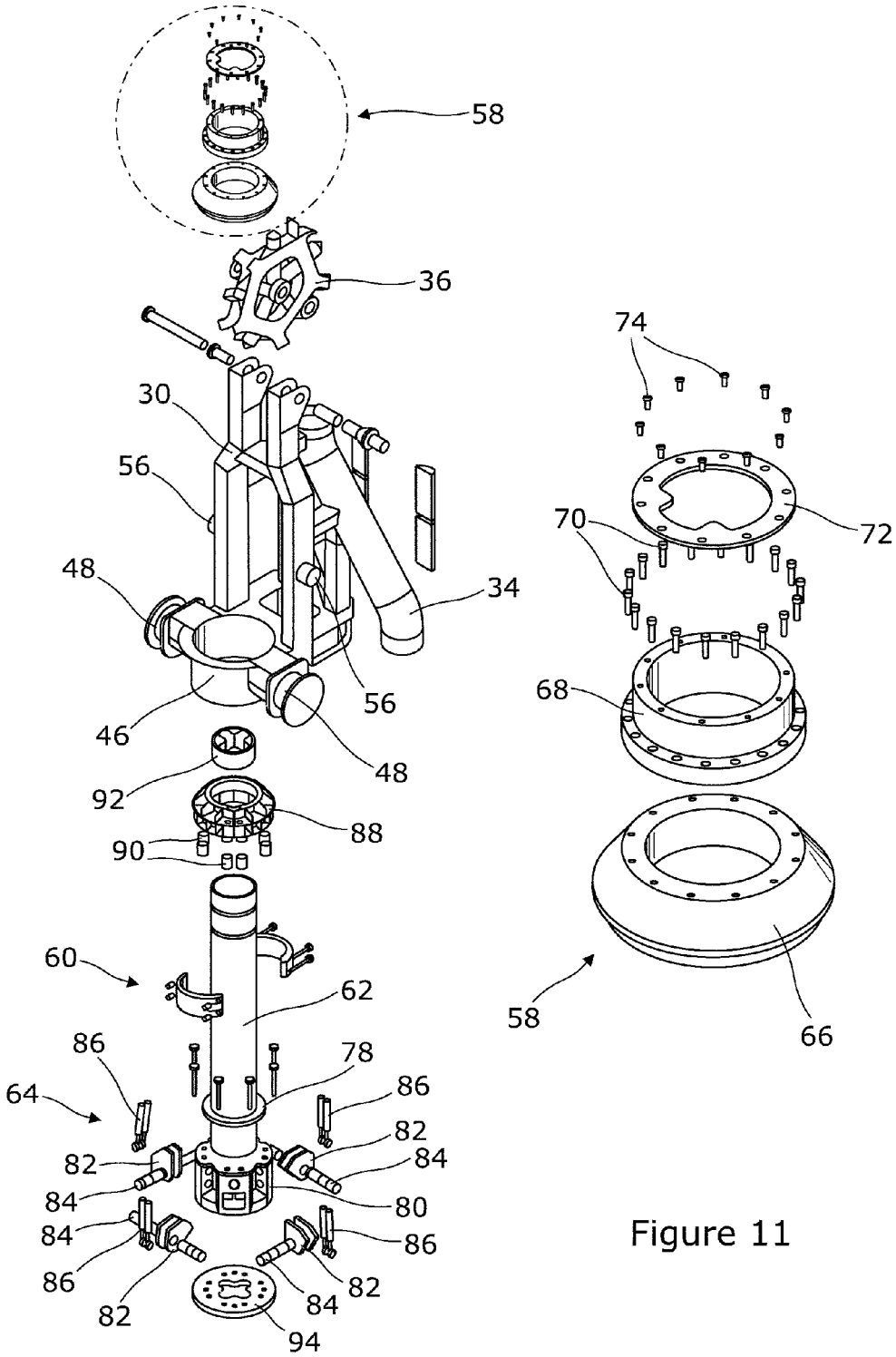
FIG. 11 is an exploded perspective view of the top connector of FIGS. 6 to 10, including an enlarged detail view of a flex joint shown circled.
Figure 12:
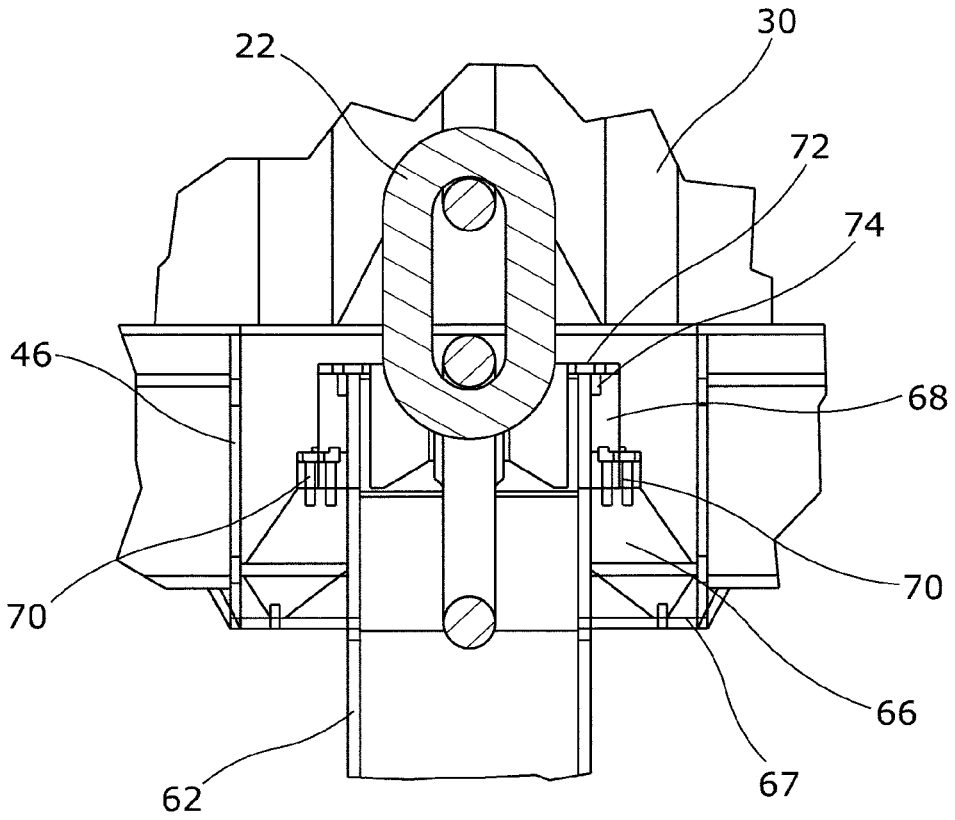
FIG. 12 is an enlarged cross-sectional detail view of a collar part of the top connector of FIGS. 6 to 10, with an annular bush shown seated in the collar and a top chain shown extending through the bush.

The exploded view of FIG. 11 shows the flex joint 58 in detail and FIG. 12 shows a cross section of the flex joint 58 with a top chain 22 passing through it. FIG. 12 particularly shows how the a flex joint 58 allows a large central aperture for the top chain 22, leaving clearance around the top chain 22 to reduce wear and to promote free angular movement of the chain links within the flex joint 58.

The flex joint 58 comprises a steel-reinforced elastomeric annular bush 66 that seats on a base flange 67 within the collar 46 of the frame 30 and is coupled to the down tube 62 of the articulating member 60. Elastic deformation of the bush 66 permits angular displacement of the articulating member 60 while transmitting the load of the tether 16 from the chain stop mechanism 64 and the down tube 62 to the frame 30 of the top connector 12 mounted on the porch 28 of the BSR 10.

The bush 66 is surmounted by a top nut 68 attached to the bush 66 by screws 70 extending through a bottom flange of the top nut 68. In turn, the top nut 68 is surmounted by a locking plate 72 attached to an upper annular face of the top nut 68 by screws 74. The top nut 68 held by the locking plate 72 engages a male thread on the down tube 62 of the articulating member 60 to couple the down tube 62 to the bush 66.

Figure 14:
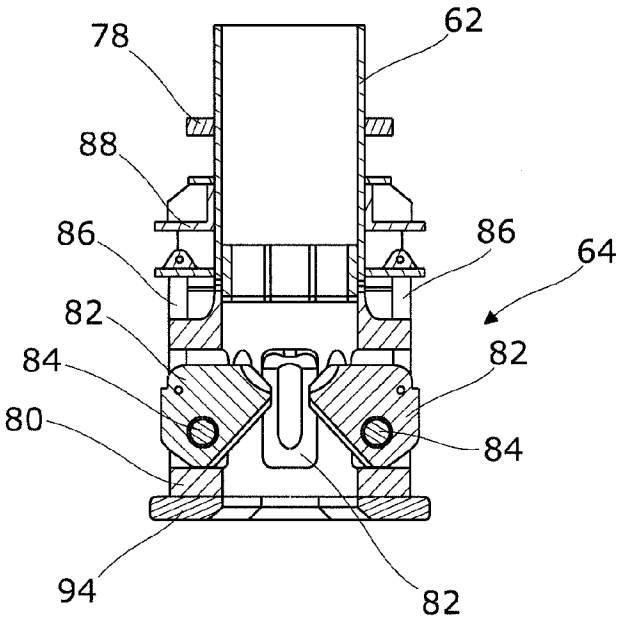
FIG. 14 is a sectional side view of the chain stop mechanism of FIG. 13.
Figure 13:
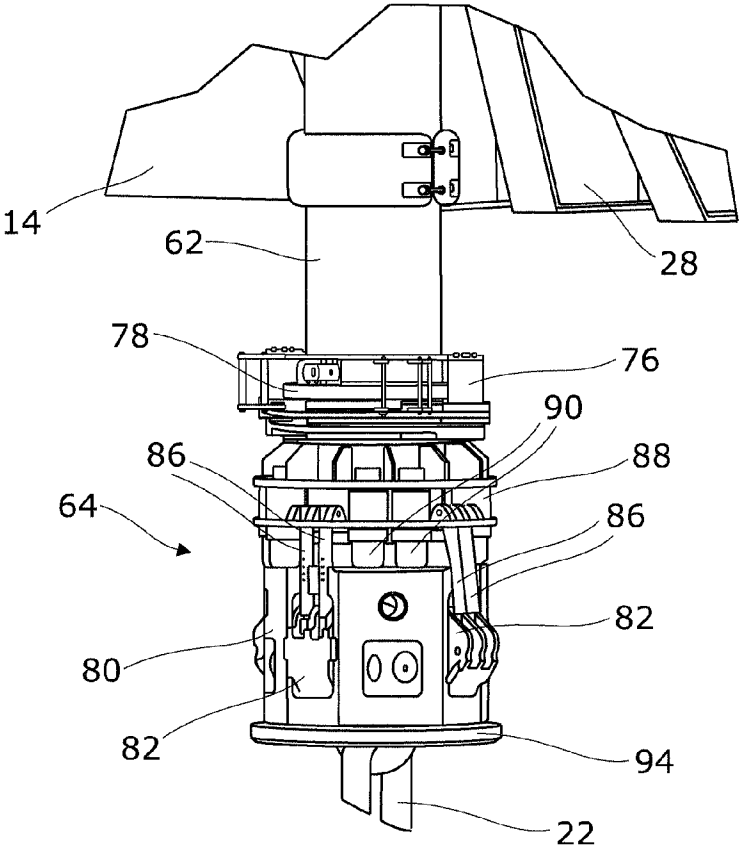
FIG. 13 is an enlarged detail perspective view of a chain stop mechanism being part of the top connector of FIGS. 2 to 10.

FIGS. 13 and 14 show the chain stop mechanism 64 in detail. FIG. 13 shows the chain stop mechanism 64 with a clutch disengagement clamp 76 also seen in FIG. 2; but the clamp 76 is omitted from FIG. 14 and from the other preceding drawings. The omission of the clamp 76 from FIG. 14 shows more clearly a flange 78 on the down tube 62 to which the clamp 76 is fitted as shown in FIG. 13. As will now be explained, the clamp 76 acts against the flange 78 to disengage the chain stop mechanism 64 from the top chain 22, also shown in FIG. 13 but omitted from FIG. 14.

The chain stop mechanism 64 comprises a dog support 80 mounted on the lower end of the down tube 62. The dog support 80 is a tubular structure that encircles the top chain 22 and supports four dogs 82 that face inwardly to engage the top chain 22. The dogs 82 are arranged in cruciform fashion, in opposed pairs in mutually orthogonal planes that intersect on the central vertical axis of the down tube 62.

Each dog 82 pivots relative to the dog support 80 about a respective horizontal pin 84. The dogs 82 are biased to pivot inwardly about the pins 84 by paired sprung rods 86 acting in tension between the dogs 82 and an annular clutch member 88 surrounding the down tube 62 atop the dog support 80. The rest position of the dogs 82 is therefore to engage the top chain 22 to resist downward movement of the top chain 22 under tension of the tether 16 in use; but when the top chain 22 is pulled upwardly by the tensioner unit 36 as will be explained, the dogs 82 pivot outwardly against the bias of the rods 86 to allow the top chain 22 to move through the dog support 80. The dogs 82 therefore provide the chain stop mechanism 64 with a ratchet function.

The clutch member 88 is a sliding fit on the down tube 62 to be moved vertically along the down tube 62 with respect to the dog support 80. The clutch member 88 is biased upwardly by sprung tubes 90 acting in compression between the bottom of the clutch member 88 and the top of the dog support 80.

To release the top chain 22 for downward movement through the dog support 80 to slacken the tether 16, the clutch disengagement clamp 76 on the flange 78 presses downwardly on the clutch member 88 against the upward bias of the sprung tubes 90. As the clutch member 88 moves closer to the dog support 80, the sprung rods 86 act in compression on the dogs 82 to pivot the dogs 82 outwardly. This allows the top chain 22 to move through the dog support 80.

To synchronise operation of the tensioner unit 36 and the chain stop mechanism 64, the clutch disengagement clamp 76 is actuated by a mechanical or hydraulic link from the tensioner unit 36.

The chain stop mechanism 64 operates on a fail-safe principle in that the dogs 82 will re-engage automatically with the top chain 22 if the tensioner unit 36 releases the top chain 22, whether in a controlled or accidental manner. Also, even if the chain stop mechanism 64 should fail, direct actuation of the dogs 82 is possible with ROV intervention.

Appropriate alignment of the links of the top chain 22 with the dogs 82 is assured by chain guides with aligned cruciform apertures on the top and bottom of the down tube 62. These chain guides are best shown in FIG. 11, namely a top guide 92 in the top of the down tube 62 and a bottom plate 94 on the underside of the dog support 80.

Figure 15:
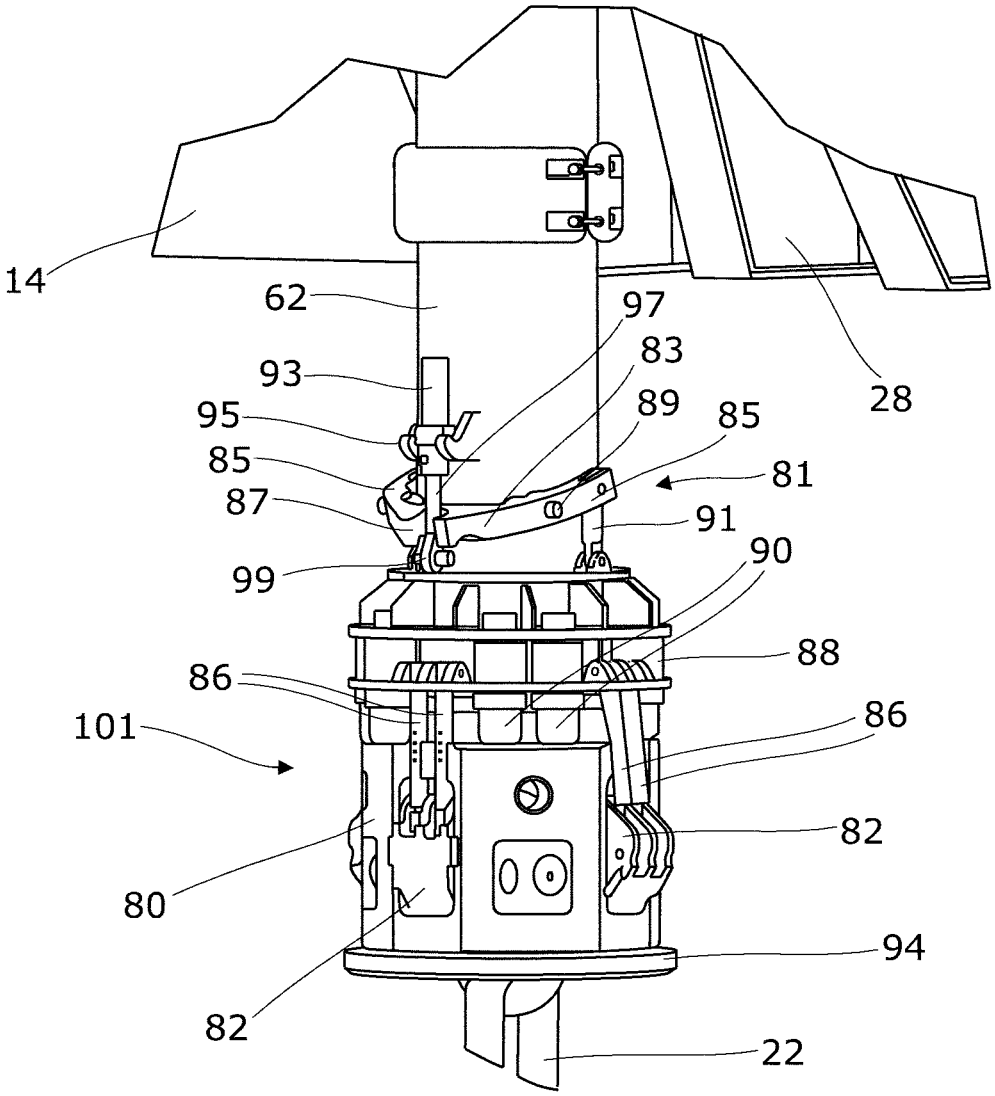
FIG. 15 is an enlarged detail perspective view of an alternative chain stop mechanism that may be used in a top connector of the invention.
Figure 16:
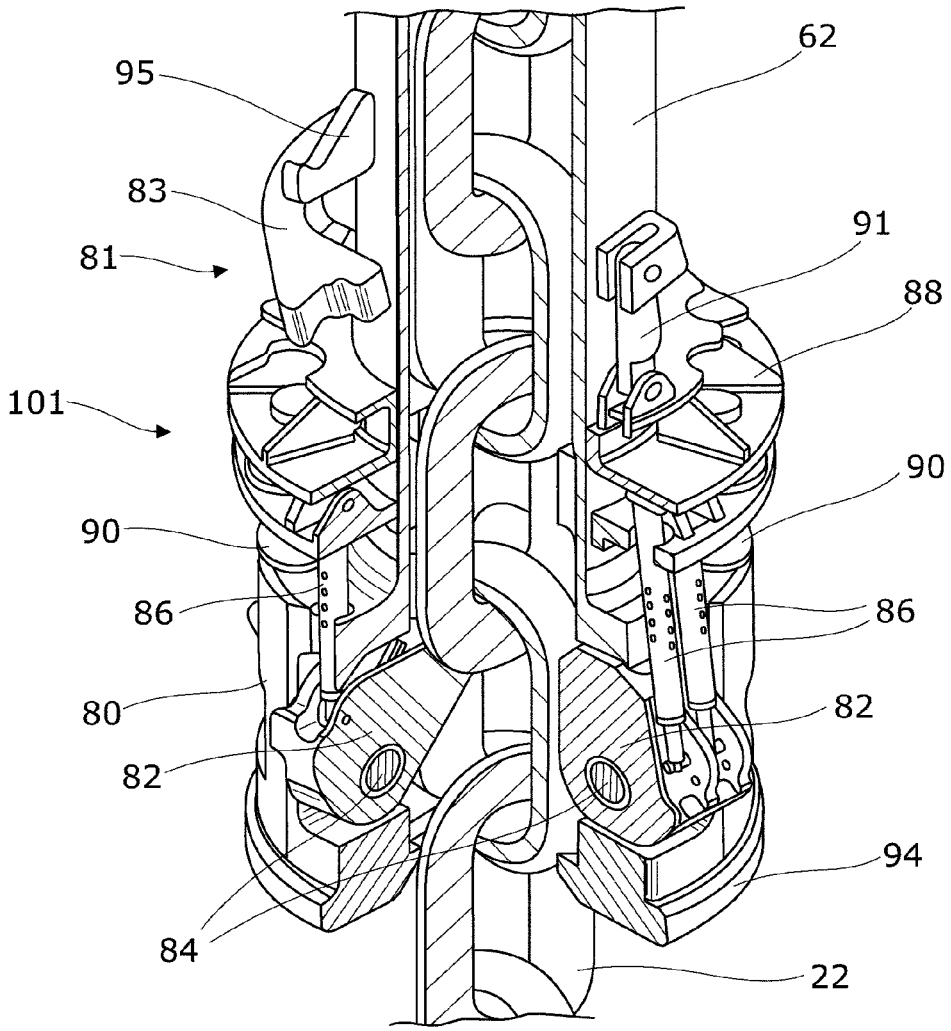
FIG. 16 is an enlarged detail part-sectioned perspective view of the chain stop mechanism of FIG. 15.

Moving on now to FIGS. 15 and 16 of the drawings, these show an alternative—and currently preferred—design for the chain stop mechanism, with the reference numeral 101. Like numerals are used for like parts.

The chain stop mechanism 101 of FIGS. 15 and 16 works in largely the same way as the chain stop mechanism 64 of FIGS. 13 and 14 in that downward movement of the clutch member 88 effects release movement of the dogs 82. The chain stop mechanism 101 differs from the chain stop mechanism 64 in how that downward movement of the clutch member 88 is achieved.

Specifically, a hydraulically-operated linkage 81 applies force downwardly at diametrically-opposed points of the clutch member 88, to opposite sides of the down tube 62. To do so, the linkage 81 comprises a pivoting link 83 that is U-shaped in plan view, having arms 85 that embrace the down tube 62 and that are joined at an apex 87.

A pivot pin 89 extends through each arm 85 into the down tube 62 to attach the pivoting link 83 for pivotal movement relative to the down tube 62. The pivot pins 89 lie on a pivot axis extending diametrically through the down tube 62.

The pivot pins 89 are disposed inboard of the ends of the arms 85. Thus, as the pivoting link 83 pivots about the pivot axis, the arms 85 can apply leverage to rods 91 that are hinged at an upper end to the ends of the arms 85 and at a lower end to the clutch member 88.

A hydraulic actuator 93 acts between the apex 87 of the U-shaped pivoting link 83 and a bracket 95 welded to the down tube 62 directly above the apex 87. When actuated, the actuator 93 acts against the bracket 95 to pull the apex of the pivoting link 83 upwardly, which applies downward pressure to the rods 91 and in turn to the clutch member 88.

The actuator 93 has a tensile rod 97 that engages the apex 87 of the pivoting link 83. The rod 97 extends through a cut-out in the apex 87 of the pivoting link 83 and terminates in a transverse head 99 that bears against the underside of the apex 87.

Referring finally to FIGS. 17 to 22 of the drawings, these show a tensioner unit 36 in detail. The tensioner unit 36 will normally be powered and operated from an installation vessel on the surface but as a contingency, it may be powered and operated by an ROV.

As noted above, a tensioner unit 36 is arranged to be docked with a top connector 12 when it is necessary to tension or slacken a tether 16. Once docked on the frame 30 of a top connector 12, a tensioner unit 36 may be left in situ for future re-tensioning or slackening operations. Tensioner units 36 may also be left in situ for the purpose of adjusting the depth of the BSR 10, in which case a set of tensioner units 36 acting on multiple tethers 16 will work together to make the necessary adjustments.

A tensioner unit 36 need not always be left in situ on a top connector 12, however. To avoid duplication and reduce cost, a tensioner unit 36 may be removed from a top connector 12 after use and used again on another pre-installed top connector 12 to tension or slacken its associated tether 16. The clutch disengagement clamp 76 shown in FIGS. 2 and 13 may also be moved from one top connector 12 to another as appropriate.

Figure 17:
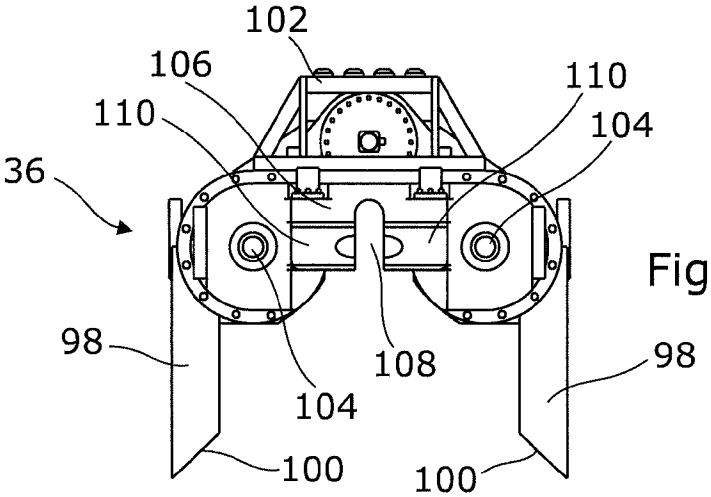
FIG. 17 is a top view of the tensioner unit shown as part of the top connector of FIG. 2 and removed from the top connector of FIGS. 3 to 10.
Figure 18:
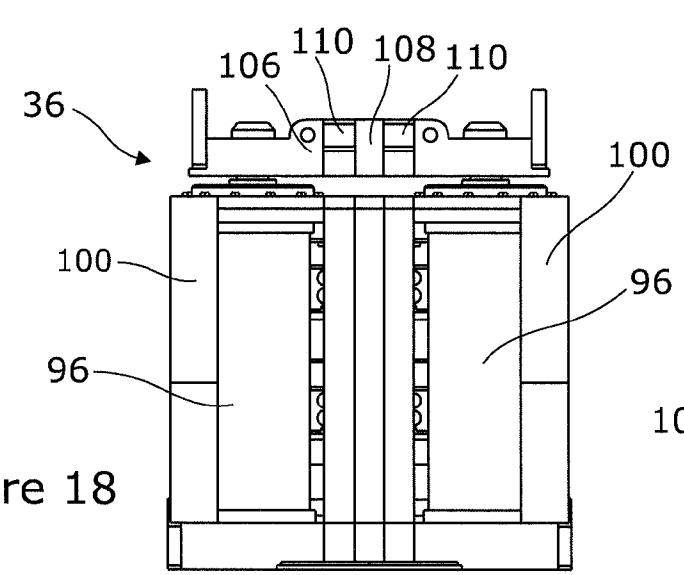
FIG. 18 is a rear view of the tensioner unit of FIG. 17.
Figure 19:
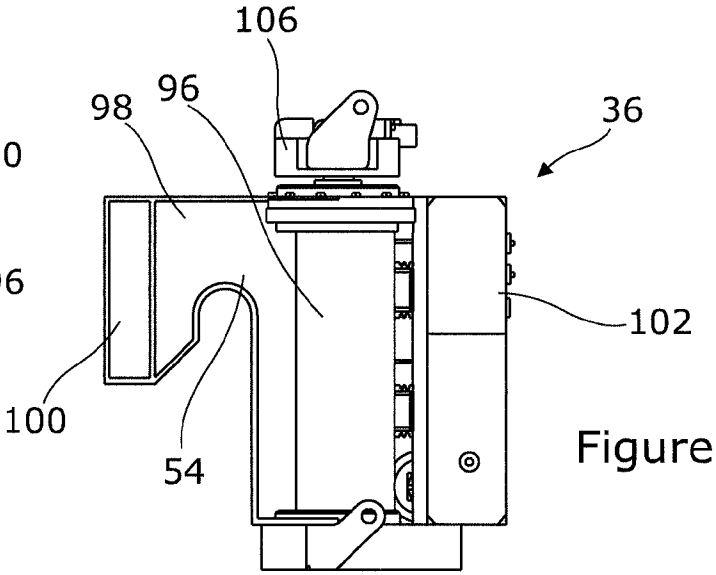
FIG. 19 is a side view of the tensioner unit of FIGS. 17 and 18.
Figure 22:
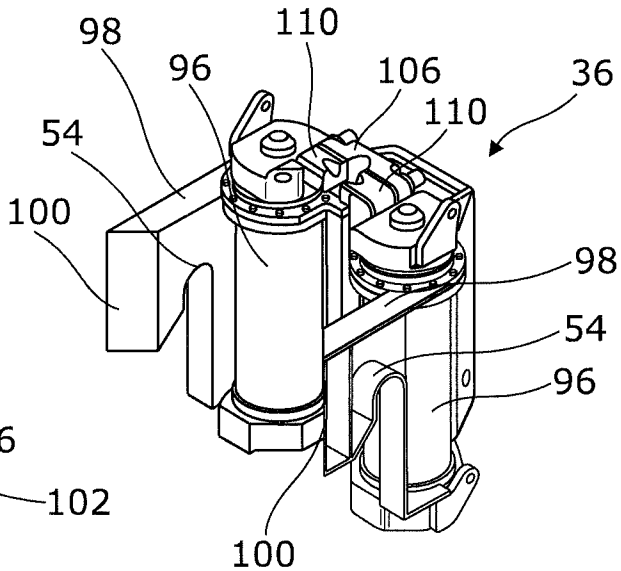
FIG. 22 is a perspective view of the tensioner unit of FIGS. 17 to 21.
Figure 21:
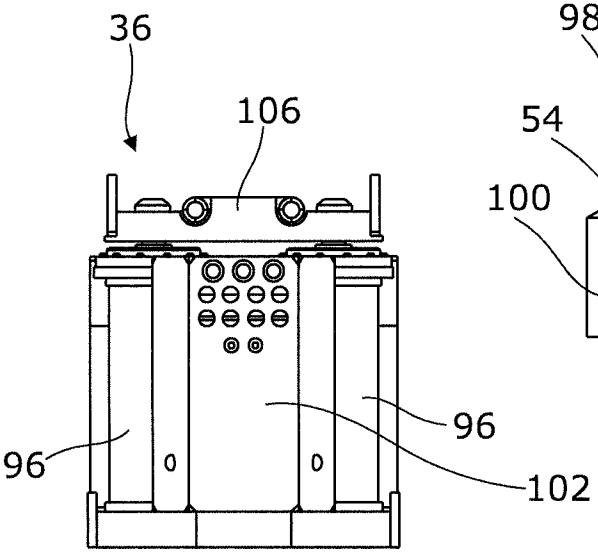
FIG. 21 is a front view of the tensioner unit of FIGS. 17 to 20.

The tensioner unit 36 shown in FIGS. 17 to 22 comprises a pair of hydraulic cylinders 96 whose parallel axes are vertical and aligned with the side wall 14 of the BSR 10 in use. The aforementioned downwardly-opening hooks 54 on the inboard side of the tensioner unit 36 for docking with the lugs 56 of the frame 30 of a top connector 12 are defined by parallel arms 98 that extend inboard from the outer sides of the cylinders 96. As best shown in FIG. 17, the arms 98 taper outwardly in plan in the inboard direction by virtue of inwardly-facing chamfered end faces 100. The chamfered end faces 100 help to align the tensioner unit 36 with the frame 30 of a top connector 12 during docking.

The outboard side of the tensioner unit 36 carries a control panel 102 for ROV intervention. The control panel 102 suitably comprises pressure gauges, override valves and energy supply jumper connections. The control panel 102 may further comprise a jumper connection to the clutch disengagement clamp 76 of the chain stop mechanism 64 to synchronise operation of the tensioner unit 36 and the chain stop mechanism 64. The hydraulic actuator 93 of the alternative chain stop mechanism 101 shown in FIGS. 15 and 16 may be controlled in a similar way.

Rods 104 extend in parallel from the cylinders 96 and are joined by a horizontal bridge member 106 that extends parallel to the side wall 14 of the BSR 10 in use. The central longitudinal axes of the rods 104 are co-planar with the top chain 22 where the top chain 22 extends vertically between the sheave 32 and the collar 46. The bridge member 106 is curved in plan view to lie on the outboard side of the top chain 22. On its inboard side, the bridge member 106 has a central cut-out 108 aligned with the top chain 22 and opposed dogs 110, one each side of the cut-out 108.

Figure 20:
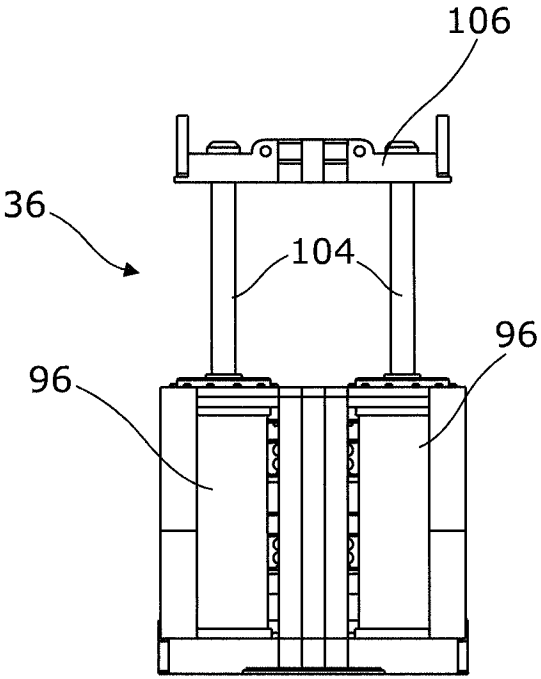
FIG. 20 is a rear view of the tensioner unit of FIGS. 17 to 19 that differs from FIG. 18 by showing rods of the tensioner unit extended.

To pull in the top chain 22 and hence to increase the tension in the associated tether 16, the dogs 110 of the tensioner unit 36 are engaged with the top chain 22 and the rods 104 are extended from the cylinders 96 as shown in FIG. 20. This pulls the top chain 22 through the chain stop mechanism 64/101, which operates as a one-way ratchet. When the bridge member 106 carried by the rods 104 reaches the end of its stroke, the chain stop mechanism 64/101 takes the load as the rods 104 are retracted slightly into the cylinders 96 and the dogs 110 of the tensioner unit 36 are disengaged from the top chain 22. The rods 104 are then retracted further back into the cylinders 96 so that the dogs 110 of the tensioner unit 36 can be re-engaged lower on the top chain 22 ready for the next stroke. These strokes of the tensioner unit 36 are repeated until the required tension is achieved in the tether 16. It is possible to monitor tension in the tether 16 by monitoring the hydraulic pressure in the cylinders 96.

With all of the tethers 16 suitably tensioned, the level and attitude of the BSR 10 can be assessed to determine if any adjustments are required. If adjustments are required, corners of the BSR 10 can be lowered or raised in the water by stroking tensioner units 36 on appropriate tethers 16 of the BSR 10 by incremental amounts until the desired position and orientation is achieved.

If it is required to slacken a tether 16, the rods 104 are extended from the cylinders 96 and the dogs 110 of the tensioner unit 36 are engaged with the top chain 22. When the tensioner unit 36 has taken the load, the dogs 82 of the chain stop mechanism 64/101 are released to free the top chain 22. The rods 104 are then retracted back into the cylinders 96, allowing the chain stop mechanism 64/101 and hence the top connector 12 to move up the top chain 22 in a manner controlled by the cylinders 96.

An inverted variant of the tensioner unit 36 is possible in which the cylinders 96 move with the dogs 110 and the rods 104 are fixed.

The tensioner unit 36 has one-link length resolution and allows mooring line length-setting in a range of say ±6 m, allowing tolerances for length and elongation of the SSW 24, slope of the seabed 20 and embedment depth of the pile foundation 18. The tensioner unit 36 provides a permanent or temporary tensioning ability for installing the BSR 10 and for replacing the tether 16, by paying-in and paying-out the top chain 22 as necessary.

Once the final position and orientation of the BSR 10 is achieved, the hydraulic force exerted by the tensioner unit 36 is relaxed to transfer the load onto the chain stop mechanism 64. The dogs 110 of the tensioner unit 36 can then be disengaged from the associated top chain 22, meaning that the portion of the top chain 22 above the chain stop mechanism 64 is no longer under tension. It is particularly to be noted that the top chain 22 is not under tension where it experiences angular displacement at the level of the flex joint 58, substantially avoiding bending fatigue and wear problems at that location.

Of course, as explained previously, bending fatigue is a particular risk in the uppermost tensioned links of the top chain 22, where relative movement is possible between links constrained by the chain stop mechanism 64 and neighbouring links below, which are not similarly constrained. In this respect, bending fatigue failure of mooring chains is a well-known problem, discussed for example in a paper presented to the 2005 Offshore Technology Conference and published as OTC 17238. That paper analyses failure of chain links close to a chain hawse or fairlead, where vessel rotations applied to a chain under high pre-tension lead to high out-of-plane bending stresses. The paper also proposes a methodology for calculating bending fatigue life of such chains.

Measuring bending fatigue life of the top chain 22 by the OTC 17238 methodology, the potential improvement enabled by the top connector 12 of the present invention is huge.

Use of an equivalent spherical bearing, which as noted above suffers from high break-out loads that render it unresponsive to micro-angular movements of the tether 16, may lead to a projected chain bending fatigue life as short as 35 years. This is clearly inadequate where the production life of a subsea oil field is typically around 30 years. In contrast, the use of a flex joint 58 in accordance with the invention increases the projected chain bending fatigue life to in excess of 16,000 years. Simply, this means that chain bending fatigue failure is no longer an issue.

Thus, the top connector 12 of the invention is designed to maintain the integrity of the top chain 22 throughout the production life of a subsea oil field. During that time, the top connector 12 must accommodate dynamic angle variations and dynamic tension variations in the tethers 16 due to variations in the footprint of the BSR 10 caused by variations in ocean current and in SCR loading, varying heel and trim angles of the BSR 10 and pitch motions of the BSR 10 due to wave-induced variations in jumper loading.

The top connector 12 of the invention is capable of withstanding maximum loads and angles for operating, extreme and accidental scenarios, including a 100-year return current or a failure such as loss of a tether or flooding of multiple compartments of the BSR 10. The top connector 12 also resists torque induced by the SSW 24 under tension and by yaw of the BSR 10, including accidental conditions, but its anti-twist functionality does not hinder articulation to accommodate angular variation of the tethers 16.

The invention claimed is:

1. A top connector for a tether of a tethered buoyant structure, the top connector comprising:

a support comprising an annular collar that surrounds and defines a seat for a resilient annular bush;

a frame extending upwardly above the support when oriented for use, the frame carrying chain-management features for supporting a portion of a chain of the tether in use; and a lever member comprising a down tube extending below the support when oriented for use, the down tube being pivotably connected to the support via a flex joint; and the flex joint comprising the resilient annular bush connected to the down tube;

wherein the down tube is pivotable relative to the support and the frame.

2. The top connector of claim 1, wherein the flex joint is arranged to bear a load exerted by the chain when the chain is engaged with a chain stop mechanism carried by the down tube.

3. The top connector of claim 2, wherein the chain stop mechanism comprises dogs biased to engage the chain as a ratchet when the chain is pulled through the chain stop mechanism on tensioning the tether.

4. The top connector of claim 2, wherein the chain stop mechanism is releasable to free the chain for slackening the tether.

5. The top connector of claim 1, wherein the frame is integral with or otherwise fixed to the support.

6. The top connector of claim 1, wherein the frame is arranged to remain in fixed relation to the buoyant structure as the down tube pivots to follow variations in departure angle of the tether.

7. The top connector of claim 1, wherein the frame carries a sheave over which a non-tensioned portion of the chain passes in use.

8. The top connector of claim 7, wherein the frame carries a chain tail management structure for guiding the non-tensioned portion of the chain, in use, downwardly and outwardly from the sheave, away from the tether.

9. The top connector of claim 8, wherein the chain tail management structure is adjustable to direct the non-tensioned portion of the chain selectively to different sides of the tether.

10. The top connector of claim 7, wherein the sheave carries the non-tensioned portion of the chain from one side of the frame to an opposite side of the frame.

11. The top connector of claim 1, wherein the frame is offset from a chain axis extending through and above the support.

12. The top connector of claim 11, wherein the frame is offset from the chain axis in an inboard or outboard direction in use.

13. The top connector of claim 1 and having a tensioner unit positioned or positionable above the support to act on a portion of the chain.

14. The top connector of claim 13, wherein: the frame is offset from a chain axis in an inboard or outboard direction in use; and the frame provides clearance on an outboard or inboard side of the chain axis for access to the chain by the tensioner unit.

15. The top connector of claim 13, wherein the tensioner unit is dockable to the top connector for engagement with a top chain portion.

16. The top connector of claim 15, wherein, when docked, the tensioner unit is seated on the support.

17. The top connector of claim 1 and being separate from and attachable to the buoyant structure, and having an underside that at least partially defines an interface surface for load transmission between the top connector and the buoyant structure.

18. The top connector of claim 17, wherein the interface surface includes an underside of the support.

19. The top connector of claim 17 and having at least one locating formation arranged to lock the top connector against movement relative to the buoyant structure.

20. The top connector of claim 19, wherein the locating formation projects from the support.

21. The top connector of claim 19, and having a lifting formation on the locating formation.

22. A tethered buoyant structure in combination with at least one top connector as defined in claim 1.

23. In combination, a top connector as defined in claim 1 with a tensioner unit attachable to the top connector to act on the top chain, the top connector and the tensioner unit having mutually-cooperable attachment formations.

* * * * *